US009874084B2

(12) United States Patent
Park et al.

(10) Patent No.: US 9,874,084 B2
(45) Date of Patent: Jan. 23, 2018

(54) MULTIFUNCTION END CAP FOR COILED TUBE TELEMETRY

(71) Applicant: Halliburton Energy Services, Inc., Houston, TX (US)

(72) Inventors: Brian Park, Spring, TX (US); Mikko Jaaskelainen, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 102 days.

(21) Appl. No.: 14/904,090

(22) PCT Filed: Aug. 14, 2013

(86) PCT No.: PCT/US2013/054882
§ 371 (c)(1),
(2) Date: Jan. 9, 2016

(87) PCT Pub. No.: WO2015/023272
PCT Pub. Date: Feb. 19, 2015

(65) Prior Publication Data

US 2016/0153276 A1 Jun. 2, 2016

(51) Int. Cl.

| | |
|---|---|
| ***E21B 47/01*** | (2012.01) |
| ***E21B 17/20*** | (2006.01) |
| ***E21B 19/08*** | (2006.01) |
| ***E21B 47/06*** | (2012.01) |
| ***E21B 47/12*** | (2012.01) |
| ***E21B 19/22*** | (2006.01) |

(52) U.S. Cl.
CPC ..... *E21B 47/01* (2013.01); *E21B 17/20* (2013.01); *E21B 19/08* (2013.01); *E21B 19/22* (2013.01); *E21B 47/011* (2013.01); *E21B 47/06* (2013.01); *E21B 47/065* (2013.01); *E21B 47/123* (2013.01)

(58) Field of Classification Search
CPC ..... E21B 17/20; E21B 19/08; E21B 19/22; E21B 47/01; E21B 47/011; E21B 47/06; E21B 47/065; E21B 47/123
See application file for complete search history.

(56) References Cited

U.S. PATENT DOCUMENTS

| | | | | |
|---|---|---|---|---|
| 6,116,085 | A * | 9/2000 | Moffatt | E21B 17/206 166/250.01 |
| 6,497,290 | B1 * | 12/2002 | Misselbrook | E21B 17/203 166/384 |
| 7,269,320 | B2 * | 9/2007 | Herbst | G02B 6/4415 385/100 |
| 7,496,248 | B2 * | 2/2009 | Varadarajan | E21B 47/065 385/12 |
| 7,603,009 | B2 * | 10/2009 | Ramos | G01K 11/32 385/100 |
| 7,946,350 | B2 * | 5/2011 | Greenaway | E21B 17/18 166/241.1 |
| 9,121,261 | B2 * | 9/2015 | McColpin | E21B 47/01 |
| 9,302,393 | B1 | 4/2016 | Dixon et al. | |
| 9,335,224 | B2 * | 5/2016 | MacDougall | G01K 11/32 |

(Continued)

*Primary Examiner* — Matthew R Buck
(74) *Attorney, Agent, or Firm* — Gilliam IP PLLC

(57) ABSTRACT

A multifunctional end cap assembly for use in terminating the toe end of subsurface coiled tubing strings that include multiple sensors. The assembly includes provisions for turnarounds for DTS or DAS systems as well as provisions for connecting formation pressures with a pressure transducer within the coiled tubing string.

13 Claims, 4 Drawing Sheets

(56) References Cited

U.S. PATENT DOCUMENTS

| | | | | |
|---|---|---|---|---|
| 9,359,833 | B2 | 6/2016 | Jaaskelainen et al. | |
| 9,359,834 | B2 | 6/2016 | Jaaskelainen et al. | |
| 2003/0081916 | A1 | 1/2003 | Norris | |
| 2007/0110355 | A1 | 5/2007 | Jaaskelainen et al. | |
| 2008/0095496 | A1 | 4/2008 | Varadarajan et al. | |
| 2010/0092145 | A1 | 4/2010 | Read | |
| 2010/0314096 | A1* | 12/2010 | Hansen | E21B 47/01 166/65.1 |
| 2011/0073210 | A1 | 3/2011 | Stretch et al. | |
| 2012/0039561 | A1 | 2/2012 | MacDougall et al. | |
| 2016/0076339 | A1* | 3/2016 | Martin | E21B 47/011 166/57 |

* cited by examiner

MULTIFUNCTION END CAP FOR COILED TUBE TELEMETRY

CROSS-REFERENCE TO RELATED APPLICATIONS

Not applicable.

BACKGROUND

Coiled tubing systems for subsurface applications are well known in the oil and gas industry. The term normally connotes a relatively small diameter continuous tubing string that can be transported to a well site on a drum or in a reel. Methods for inserting coiled tubing systems into existing wells are well known in the art. As oil and gas exploration technology continues to improve the demand for better wellbore information grows and there has been more interest in using coiled tubing to deploy more instrumentation into the wellbore, particularly pressure and temperature sensors.

As fiber optic telemetry develops there is increased need to install multiple fiber optic sensors inside coiled tubing. Each sensor may require its own FIMT (fiber in metal tubing), so there needs to be a method and devices to enable multiple FIMTs to be installed simultaneously in lengths of coiled tubing that can vary up to 10 km.

DETAILED DESCRIPTION

Figure 1:
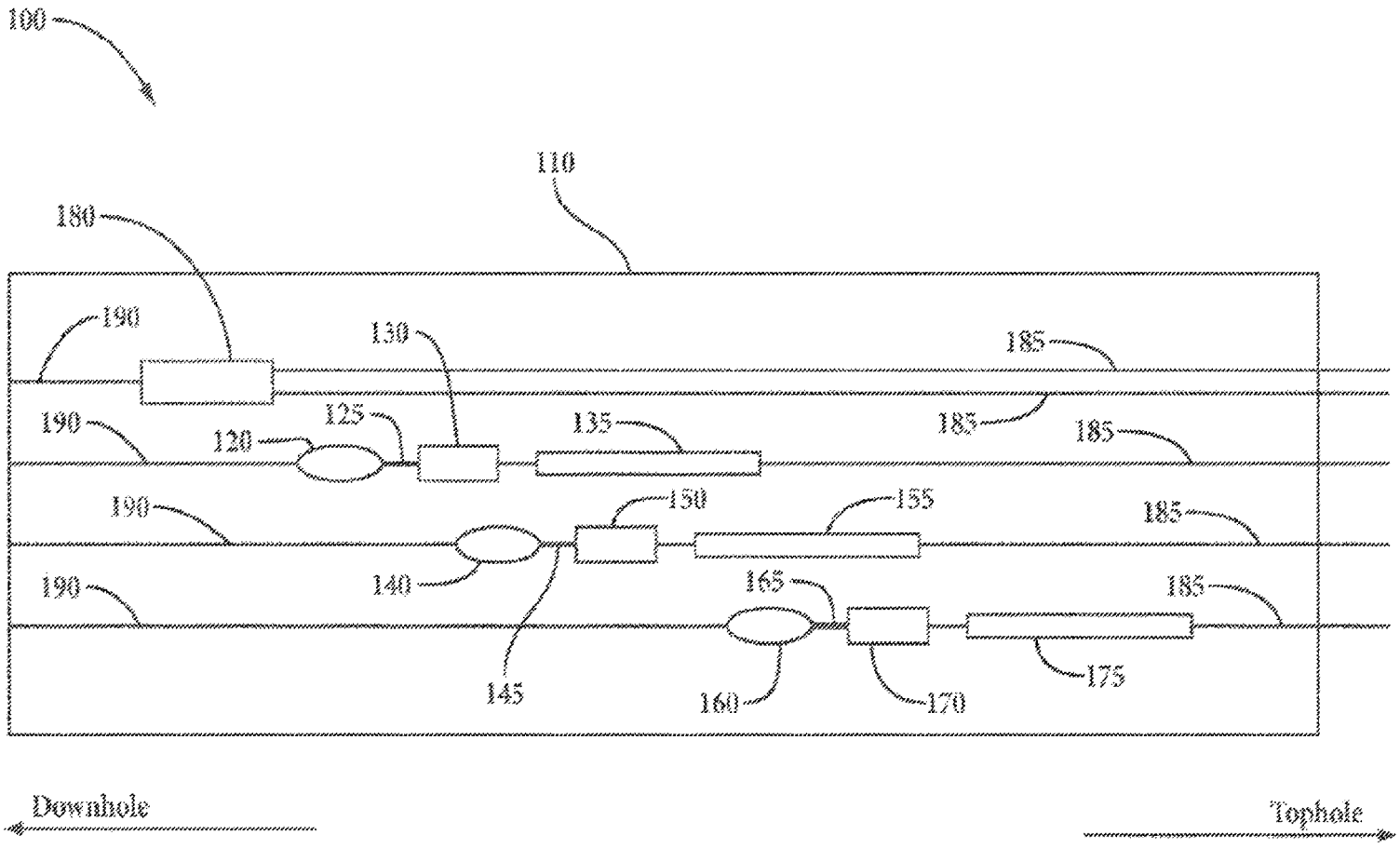
FIG. 1 (Prior Art)
FIG. 1 illustrates an example configuration of multiple fiber optic sensors in metal tubing (FIMT's) deployed in coiled tubing.

In the following detailed description, reference is made that illustrate embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken in a limited sense, and the scope of the disclosure is defined only by the appended claims.

The method and device to be described herein can be used for installing various and multiple types of sensors into a coiled tubing system to be used down hole in oil and gas operations. Example sensor systems may include multiple fiber optic and/or vibrating wire and/or conventional tubing encapsulated conductor (TEC) lines and pressure transducers. Other types of sensor commonly found in logging operations including but not limited to Distributed Temperature Sensing (DTS), Distributed Acoustic Sensing (DAS), single point acoustic sensors, resistivity measuring devices, radiation measuring devices, chemical sensors etc. are also possible.

A typical fiber telemetry system inside coiled tubing might consist of three fiber optic pressure transducers, one at the heel, one at the toe and one in the middle of the horizontal portion, along with additional fiber for DTS or DAS telemetry. Each sensor may have single or multiple fibers, which are normally run inside FIMTs. Thus as many as 5 or more FIMTs may have to be installed in the coiled tubing at the same time.

The sensors, comprising e.g., fiber optic, vibrating wire or TEC (Tubing Encapsulated Conductor) cables, chemical sensors, electromagnetic sensors, pressure sensors and pressure block housing can be pulled and/or pumped into the coiled tubing. The sensing string can also include various electrical sensors, including point thermocouples for temperature sensing as well as DTS system calibration. The DTS and or DAS fibers can be deployed inside a FIMT along with the pressure sensors, or pumped into a conduit after installation. The fiber for the DTS can be pumped into a double-ended conduit for some coil deployments. The location of the pressure transducers, e.g. pressure sensor and pressure block housing are carefully measured before they are pulled into the coil. The exact location can then be identified using e.g. x-ray systems and/or ultrasonic systems and/or DAS systems by tapping on the coiled tubing and/or by DTS systems and apply a thermal event or other similar methods where distance can be verified and compared with distances measured before the sensing string is pulled into the coiled tubing. Penetrations can then be drilled though the coil at suitable locations, and suitable seals can be applied to/activated on the assembly. All of the installation of the sensor systems into the tubing is done in the coiled tubing before the tubing is deployed downhole.

FIG. 1, represented by the numeral 100, illustrates one approach from the prior art for dealing with the multiple installations described above. A coiled tubing 110 is shown in a cross sectional view to expose the inner installation. The illustration is a horizontal tubing run—the heel portion is nearest to the top hole, the toe portion closest to the down hole. Three pressure transducers, each consisting of a pressure housing linked to a pressure sensor via a pressure line, and a splice housing are shown. Pressure housing 120, pressure line 125, pressure sensor 130, and splice housing 135, are to be deployed in the toe portion of the tubing. Pressure housing 140, pressure line 145, pressure sensor 150, and splice housing 155, are to be deployed in the middle portion, and pressure housing 160, pressure line 165, pressure sensor 170, and splice housing 175, are to be deployed in the heel portion.

A turnaround housing 180, to be installed at the toe portion, is used for deployment of Distributed Temperature or Distributed Acoustic sensor fibers that are fed from the top hole to the downhole and back to the surface.

Each of these sensors may require a FIMT (fiber in metal tubing) run. Five of these 185 are shown. In this example each of the three pressure transducer systems and the turnaround housing has pull cables 190 attached on the downhole ends to enable pulling the systems through during initial installation. In this approach each FIMT is pulled by a separate pull cable in the downhole direction and each gauge has its own FIMT. There is one splice per gauge and one fiber per FIMT.

The prior art version shown in FIG. 1, as well as other possibilities of fiber based coiled tubing assemblies, usually consist of discrete pressure sensors and FIMTs (Fiber in Metal Tubing), some of which act as temperature sensors themselves using DTS techniques (Distributed Temperature Sensing), or act as acoustic sensors using DAS (Distributed Acoustic Sensing) techniques or as conductors of photonic information from the pressure sensors to the surface. The device of this disclosure—namely the end cap at the bottom end of the coiled tubing, is a new aspect that provides a plurality of functions not previously available. It provides, in one part, a weldable seal for the end of the coiled tubing, a pressure inlet for a pressure transducer, an inbuilt turnaround for pumped field replaceable DTS fiber, and a test port for testing the pressure transducer before deployment downhole. The end cap to be described can be used by itself for single pressure transducers located at the end of the coiled tubing, in conjunction with DTS sensor systems, and with multiple pressure transducers mounted further up hole by other means. In addition electrical temperature devices can be installed in the coiled tubing to act as references for the DTS fiber.

Figure 2:
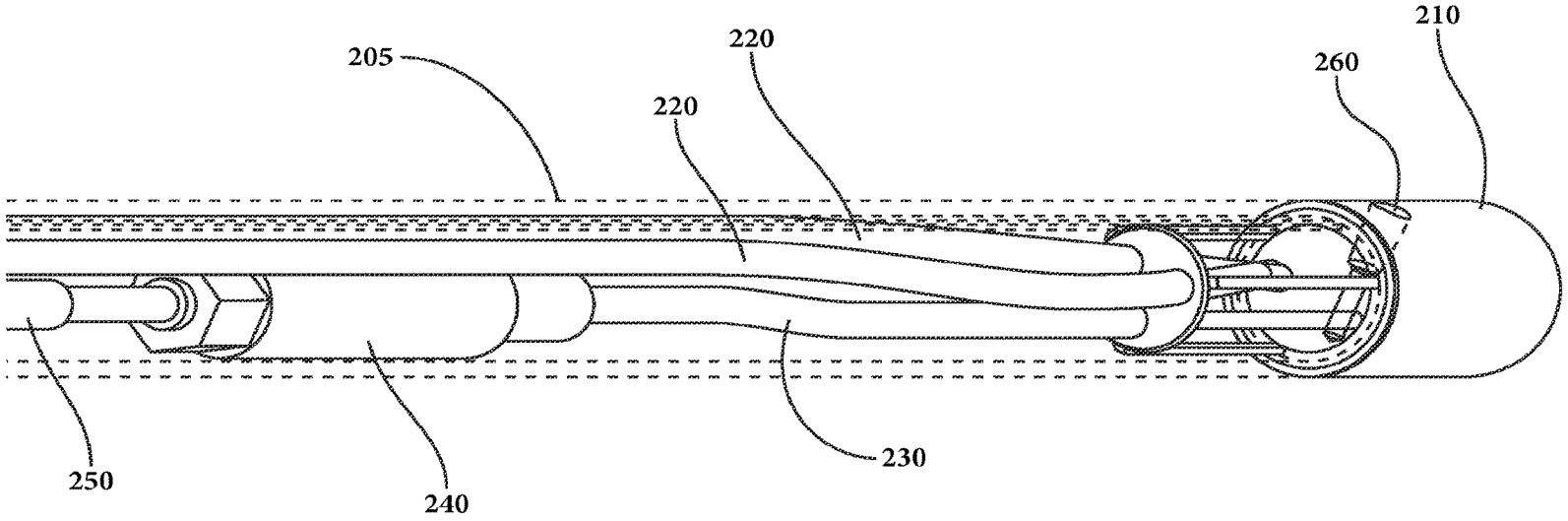
FIG. 2 illustrates the addition of the end cap of this disclosure and the potential connection of the multiple sensors such as those of FIG. 1.

An end cap assembly 210 welded in place at the bottom hole end of the coiled tubing string 205 is shown in FIG. 2. Shown in this example are two metal conduits containing fiber optic sensors that might be used for DTS or DAS sensor purposes. In addition a pressure transducer 240 near the toe or downhole position of the wellbore is shown, connected downhole to end cap 210 and uphole through a splice housing 250.

Figure 3:
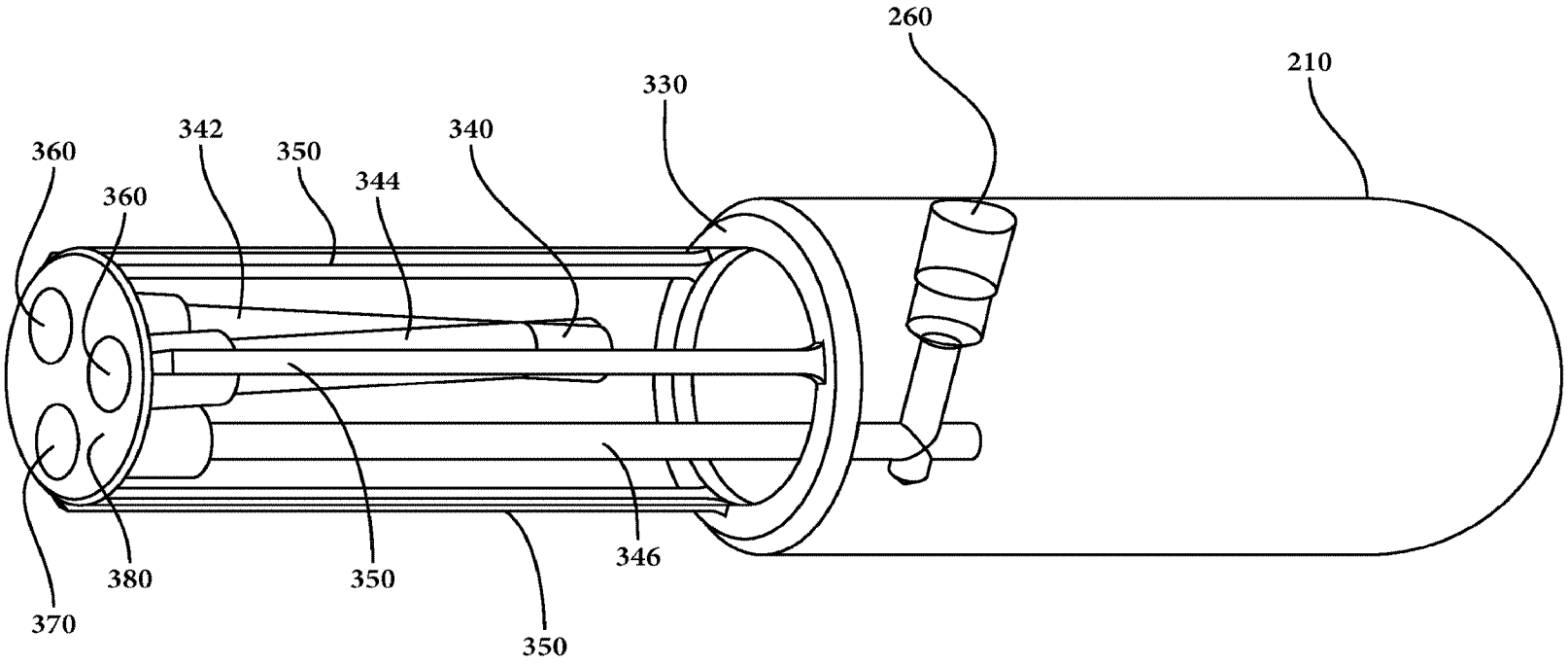
FIG. 3 illustrates a more detailed view of the of the elements of the proposed end cap.

In FIG. 3 a more detailed look illustrates the complete functionality of the proposed end cap assembly. The end cap 210 normally has the single function of sealing the end of the coiled tubing from subsurface formation fluids entering the tubing. In the end cap of this disclosure the sealing is accomplished by providing a flat weldable surface 330 to which the end of the coiled tubing string is welded. Centralizing ribs 350 extend from the location of the weldable surface and extend into the interior of the coiled tubing string and end connected to a front plate 380 of the complete end cap assembly.

First and second conduits 342, 344 connect through openings 360 in the front plate 380 and converge to form a turnaround conduit 340 within the end cap. Conduit tubing such as the two tubes 220 shown in FIG. 2 are connected at the openings 360, connecting to the turnaround 340 and providing communication tophole all the way back to the surface. One of the two tubes 220 can act as a conduit for optical fiber that is pumped into the tube while the other acts as a return for the fluid. While such a use for a turnaround is known, it is not normally integrated into an end cap. This enables the fiber to be retrieved in the field and replaced should its signal quality deteriorate over time.

In addition to this basic function, the following other functions can be described. An inlet port 260 is drilled into the side of the end cap to create a pressure pathway from the outside of the end cap to the interior of the cap. This pathway is connected by pressure tubing 346 to a third opening 370 in the front plate 380 of the end cap assembly, which in turn connects to a pressure transducer such as transducer 240 in FIG. 2, via tube 230 in FIG. 2. The transducer may be purely optical and transmit its signal to the surface via optical fiber, or it may be electrical, using electrical cable to transmit its signal to the surface. Instead of requiring a separate pressure interface to the coiled tubing, the end cap performs this function.

A thread is machined at the inlet port 260 on the side of the end cap so that a pressure fitting can be attached for testing of the pressure transducer, eliminating the need for an additional pressure interface to the coiled tubing.

The centralizing ribs 350 hold the end cap in place and provide clearance for a weld bead commonly found in coiled tubing. Coiled tubing typically consists of a tube of about 32 millimeters external diameter made from cold rolled steel. Commonly this results in an internal raised lip or bead running the entire length of the coiled tube where the weld is made, typically between 1.6 to 3.1 millimeters high and wide.

Figure 4:
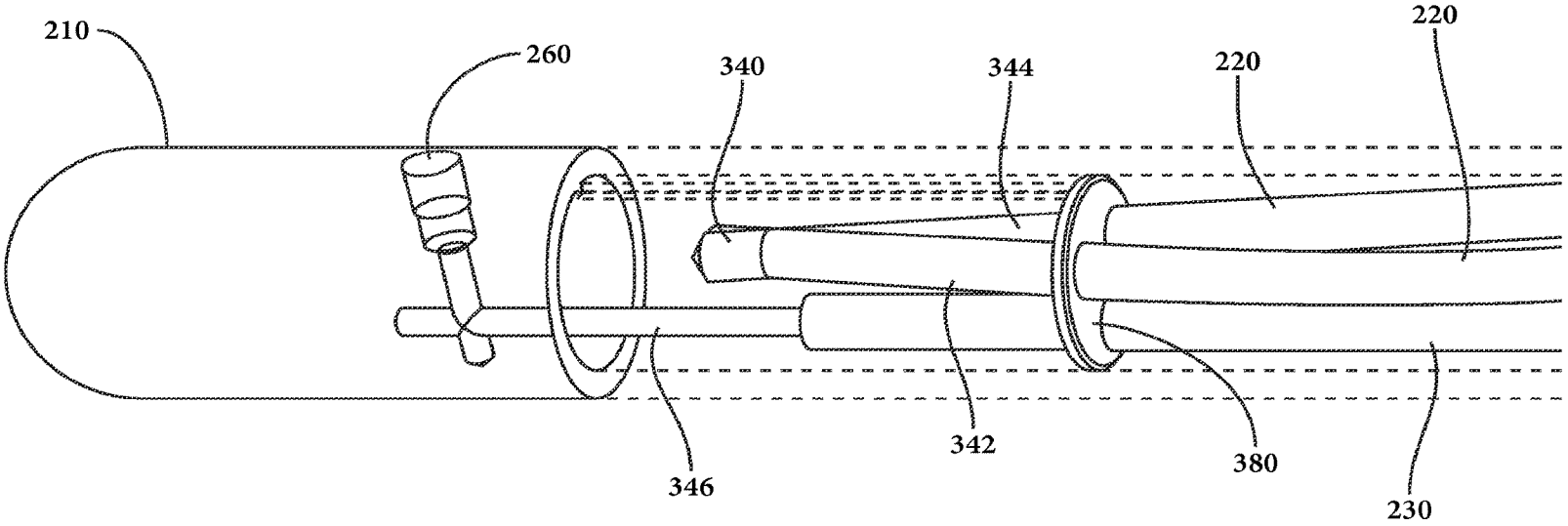
FIG. 4 illustrates an alternate view of the end cap and its connections and functions.

FIG. 4 is an alternate view to aid in further illustrating the functionality of end cap 210. The three tubes 220, 230 entering through front plate 380 of the end cap consist of two metal tubes 342, 344 converging internally at the turnaround 340. The pressure tube 230 coming from the uphole side from a pressure transducer connects through tubing 346 eventually to the pressure inlet port 260, providing pressure connectivity to the pressure transducer.

Alternate embodiments can be described. Rather than a turnaround, a single ended conduit can be used for pumping fiber. This can be done by having the pumping fluid pass out through a check valve and out a hole in the end cap (not shown). This embodiment would allow room in the coiled tubing for an additional conduit to be used for an additional pressure gauge somewhere along the length of the coiled tubing.

In an alternate embodiment the coil annulus of the coiled tube could be used as the return fluid pump path for the pump fluid used to pump a fiber into a conduit instead of a return conduit. This approach could also be used to pump out optical fibers from a conduit by reversing the flow and pumping fluid down the annulus would allow fluid to be pumped in the reverse direction in order to remove the optical fiber.

The end cap described provides multiple functions previously performed by multiple devices. The turnaround consisted of a separate housing mounted to the ends of the conduit tubing. The pressure port was a separate piece which was either installed by cutting the coiled tubing and welding the port in place, or pulled into the tubing and detecting it by x-ray detectors and then drilling and pinning the part in place. While these methods are useful for installing transducers at the heel or other position uphole, the end cap described herein dispense with these techniques for the toe end of the tubing and simplifies the process.

In use a method for installing sensors for subsurface coiled tubing strings using the multifunction end cap can be described as follows. The method begins by performing at least: coupling the multifunction end cap to the toe or lower end of a subsurface coiled tubing string; wherein the multifunction end cap includes at least an integrated turnaround and an inlet port opening in the side of the multifunction end cap; coupling the inlet port opening via pressure conduit tubing to a pressure transducer within the coiled tubing; coupling the integrated turnaround to conduit tubing within the coiled tubing; welding the end cap to the coiled tubing to seal against the toe end of the coiled tubing; and running a fiber optic sensor into the conduit tubing coupled to the integrated turnaround.

Running the fiber optic sensor into the conduit tubing coupled to the integrated turnaround can be accomplished by circulating a fluid flow through the conduit tubing coupled to the integrated turnaround to carry the fiber optic sensor through the integrated turnaround and back to the surface. Using the circulating fluid to pump a pull cable through the turnaround and attaching the pull cable to the fiber optic sensor to draw the fiber optic sensor into the coiled tubing can also accomplish this. After this is done the coiled tubing with the installed fiber optic sensors can be installed in a subsurface installation and employed for distributed temperature or distributed acoustic sensing.

The described end cap represents an improved system and method for installing sensors near the toe end of coiled tubing assemblies.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

The invention claimed is:

1. A multifunction end cap assembly for sealing a toe or lower end of a subsurface coiled tubing string comprising:

a. a metallic end cap including a weldable surface used to seal against the toe end of the coiled tubing string;

b. multiple ribs extending from a location of the weldable surface and into an interior of the coiled tubing string and attached to a front plate of the end cap assembly;

c. a turnaround for sensing optical fibers positioned within the extended ribs and connected by first and second conduits to first and second openings in the front plate of the end cap assembly, wherein the first and second conduits are positioned within the extended ribs;

d. an inlet port opening in a side of the metallic end cap providing a pressure pathway from outside the end cap through a third conduit to a third opening in the front plate of the end cap assembly, wherein the third conduit is positioned within the extended ribs.

2. The multifunction end cap assembly for sealing the toe or lower end of the subsurface coiled tubing string of claim 1 further comprising:

a. conduit tubing within the coiled tubing string connected to the first and second openings of the front plate of the end cap assembly and providing communication from the first and second conduits of the turnaround positioned within the extended ribs back to a surface of a wellbore into which the subsurface coiled tubing string is to be positioned.

3. The multifunction end cap assembly for sealing the toe or lower end of the subsurface coiled tubing string of claim 1 further comprising:

a. pressure tubing within the coiled tubing string connected to the third opening of the front plate of the end cap assembly, wherein the pressure tubing is to provide pressure communication to the inlet port opening in the side of the end cap and wherein the pressure tubing is connected within the coiled tubing string to a pressure transducer.

4. A multifunction end cap assembly for sealing a toe or lower end of a subsurface coiled tubing string comprising:

a. a metallic end cap including a weldable surface used to seal against the toe end of the coiled tubing string;

b. multiple ribs extending from a location of the weldable surface and into an interior of the coiled tubing string and attached to a front plate of the end cap assembly;

c. a single ended conduit to sense an optical fiber and positioned within the extended ribs and connected to a first opening in the front plate of the end cap assembly; said single ended conduit exiting an opening in the end cap via a check valve;

d. an inlet port opening in a side of the metallic end cap providing a pressure pathway from outside the end cap through a second conduit to a second opening in the front plate of the end cap assembly, wherein the second conduit is positioned within the multiple ribs.

5. The multifunction end cap assembly for sealing the toe or lower end of the subsurface coiled tubing string of claim 4 further comprising:

a. conduit tubing within the coiled tubing string connected to the first opening of the front plate of the end cap assembly, wherein the conduit tubing is to provide communication from the single ended conduit positioned within the extended ribs back to a surface of a wellbore into which the subsurface coiled tubing string is to be positioned.

6. The multifunction end cap assembly for sealing the toe or lower end of the subsurface coiled tubing string of claim 4 further comprising:

a. pressure tubing within the coiled tubing string connected to the second opening of the front plate of the end cap assembly, providing pressure communication the inlet port opening in the side of the end cap and then connected within the coiled tubing string to a pressure transducer.

7. A method for installing sensors for subsurface coiled tubing strings, the method comprising:

a. coupling a multifunction end cap to a toe or lower end of a subsurface coiled tubing string; wherein said multifunction end cap comprises an integrated turnaround coupled to first and second conduits positioned in the multifunction end cap and an inlet port opening in a side of the multifunction end cap coupled to a third conduit positioned in the multifunction end cap;

b. coupling the inlet port opening via the third conduit and pressure conduit tubing to a pressure transducer within the coiled tubing;

c. coupling the integrated turnaround via the first and second conduits to conduit tubing within the coiled tubing;

d. welding the end cap to the coiled tubing to seal against the toe end of the coiled tubing; and e. running a fiber optic sensor into the conduit tubing and the first and second conduits coupled to the integrated turnaround.

8. The method of claim 7 wherein said running a fiber optic sensor comprises circulating a fluid flow through the conduit tubing coupled to the integrated turnaround to carry the fiber optic sensor through the integrated turnaround and back to a surface of a wellbore into which the subsurface coiled tubing string is to be positioned.

9. The method of claim 7 wherein said running a fiber optic sensor comprises circulating a fluid flow through the conduit tubing coupled to the integrated turnaround to pump a pull cable through the integrated turnaround; attaching the pull cable to the fiber optic sensor; and pulling the fiber optic sensor through the integrated turnaround and back to a surface of a wellbore into which the subsurface coiled tubing string is to be positioned.

10. The method of claim 7, further comprising installing the coiled tubing in a subsurface environment and employing the fiber optic sensor for distributed temperature or distributed acoustic sensing.

11. A method for installing sensors for subsurface coiled tubing strings, the method comprising:

a. coupling a multifunction end cap to a toe or lower end of a subsurface coiled tubing string; wherein said multifunction end cap comprises a single ended conduit exiting an opening in the end cap via a check valve, and an inlet port opening in a side of the multifunction end cap coupled to a second conduit positioned in the multifunction end cap;

b. coupling the inlet port opening via the second conduit and pressure conduit tubing to a pressure transducer within the coiled tubing;

c. coupling the single ended conduit to conduit tubing within the coiled tubing;

d. welding the end cap to the coiled tubing to seal against the toe end of the coiled tubing; and e. running a fiber optic sensor into the conduit tubing coupled to the single ended conduit.

12. The method of claim 11 wherein said running a fiber optic sensor comprises circulating a fluid flow through the conduit tubing coupled to the single ended conduit and out of the opening in the end cap via the check valve to carry the fiber optic sensor to the toe end of the coiled tubing string.

13. The method of claim 11, further comprising installing the coiled tubing in a subsurface environment and employing the fiber optic sensor for distributed temperature or distributed acoustic sensing.

* * * * *